United States Patent [19]

Kuehnle et al.

[11] Patent Number: 4,504,138

[45] Date of Patent: Mar. 12, 1985

[54] METHOD AND APPARATUS FOR DEVELOPING ELECTROSTATIC LATENT IMAGES

[75] Inventors: Manfred R. Kuehnle, New London, N.H.; Josef Matkan, Malvern, Australia; Kenneth D. Fraser, Scarboro, Canada

[73] Assignee: Coulter Systems Corporation, Bedford, Mass.

[21] Appl. No.: 315,542

[22] Filed: Oct. 27, 1981

[51] Int. Cl.[3] ..... G03G 15/10

[52] U.S. Cl. ..... 355/10; 118/661; 430/119; 355/77

[58] Field of Search ..... 355/10, 3 BE, 16, 77; 118/651, 661; 430/117-119

[56] References Cited

U.S. PATENT DOCUMENTS

| | | | |
|---|---|---|---|
| 4,259,005 | 3/1981 | Kuehnle | 118/661 X |
| 4,262,998 | 4/1981 | Kuehnle et al. | 355/10 |
| 4,325,627 | 4/1982 | Swidler et al. | 355/10 |
| 4,373,469 | 2/1983 | Kuge et al. | 118/652 |

*Primary Examiner*—Richard L. Moses

*Attorney, Agent, or Firm*—Silverman, Cass & Singer, Ltd.

[57] ABSTRACT

A method of developing a latent electrostatic charge image formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer, transferring the toner particles from the applicator roller to the photoconductor surface due to the preferential adherence thereof to the photoconductor surface under the dominant influence of the electric field strength of the electrostatic latent image carried by said photoconductive surface, the quantity of toner particles transferred being proportional to the relative incremental field strength of the latent electrostatic image. Apparatus is provided for carrying out the method of the invention which includes an applicator roller mounted for rotation in a container for toner suspension, an electrode arranged adjacent the circumferential surface of said roller to define an electrodeposition chamber therebetween and electrical connections between the said roller, electrode and a voltage source to enable electrolytic separation of toner particles in the chamber forming a thin highly viscous layer of concentrated toner particles on the roller, the roller arranged to define a virtual "zero" gap with the photoconductive surface carrying the latent electrostatic image, the virtual "zero" gap approximating the thickness of the electrodeposited toner layer.

29 Claims, 4 Drawing Figures

METHOD AND APPARATUS FOR DEVELOPING ELECTROSTATIC LATENT IMAGES

BACKGROUND OF THE INVENTION

This invention relates generally to the development of latent electrostatic images which are formed on the photoconductive surface of electrophotographic members. More particularly, the invention provides a method and apparatus for effecting such development by transfer rather than using conventional electrophoretic liquid development techniques.

The formation of a latent electrostatic image on the surface of a photoconductive member by electrophotographic means is well known to the art. Likewise, the development of such electrostatic image to render same visible also is well known to the art. The electrophotographic technique of image reproduction involves placing a uniform electrostatic surface charge potential on a photoconductive surface, exposing the charged photoconductive surface to a radiation pattern so as to form a latent electrostatic image and then developing the latent electrostatic image by depositing thereon finely divided usually pigmented electroscopic particulate material referred to in the art generally as toner. The toner particles are attracted to those areas of the surface retaining the electrostatic charge in proportion to the field strengths of the respective incremental areas defining the pattern. The toned image either may be fixed or fused to said surface as by heat or other suitable means or may be transferred to a secondary support medium such as paper and then fixed thereupon if desired or necessary.

In some known electrophotographic copying or duplicating machines the photoconductive member is in the form of a drum which rotates relative to a plurality of processing stations. For high speed copying it has been found that the photoconductive surface should be in a flattened or planar disposition at the time of exposure in order to ensure complete focussing of the original document or article being copied. Consequently, it has been found advantageous to employ a photoconductive member in the form of an endless belt or web mounted for rotational movement across at least two spaced rollers and defining a pair of generally parallel reaches.

Regardless of whether the photoconductor member is in the form of a drum or of an endless belt mounted on rollers, the latent electrostatic charge image carried thereon can be developed into a visible image by using methods categorized as so-called dry methods, for example, cascade development and magnetic brush development, and so-called wet methods involving employment of a dispersion or suspension of electroscopic pigmented toner particles in an insulating liquid. In liquid development the liquid containing the suspended particles is applied to the photoconductive surface to cover same in both the charged and uncharged areas. Under the influence of the electric field associated with the latent electrostatic image charge pattern, the suspended electroscopic particles migrate through the liquid toward the charged portions of the surface and separate from the suspending liquid. The migration of charged toner particles is due to the phenomenon called electrophoresis and such migration results in the deposition of the toner particles on the photoconductive surface in image configuration. The quantity of the toner particles adhering at any one location is directly proportional to the strength of the electrical field of the latent charge image at that location. The particles actually travel through the insulating liquid suspending medium toward the surface upon which they are deposited and sufficient liquid is needed to enable such migration. The electrophoretic process depends greatly upon the toner particle mobility in the insulating medium.

Electrophoretic development generally has been accomplished by flowing the liquid toner developer over the image bearing surface by immersing the image surface in a bath of such developer. Another method of development presents the developer liquid on a smooth surfaced roller and relative nonsynchronous movement of the image carrying surface and the applicator roller is effected. Some development methods include dynamically flowing a stream of the suspended particles past the image bearing surface at a station where a predetermined path is defined for such fluid flow. It is further known electrically to assist the migration of the toner particles toward the photoconductive surface employing development electrodes.

In U.S. Pat. No. 4,025,339 issued on May 24, 1977 to M. R. Kuehnle there is described an electrophotographic film that is capable of being imaged with quality and gray scale as good as, if not better than, that achieved by photographic techniques. The film comprises an inorganic coating of microcrystalline material that is bonded onto a conductive substrate. The inorganic coating may comprise a layer of radio frequency sputtered cadmium sulfide having a thickness of about 2,000 Angstroms to 2 microns. The conductive substrate may comprise a layer of indium tin oxide or other conductive material having a thickness of about 500 Å deposited on a sheet of stable polyester plastic about 5 microns thick. A latent electrostatic image formed on the film may be developed using a liquid toner.

In order to make the fullest use of the exceptional properties of the electrophotographic film described in the above noted patent, especially for high speed duplicating or copying machine applications, there is a need for a simple yet efficient technique for developing the formed latent electrostatic image with a liquid toner.

The inorganic photoconductive coating formed according to the teachings of the referenced patent is characterized particularly by its ordered microcrystalline orientation. The individual crystallites comprising the coating are density packed and all oriented generally vertically to the receiving surface with the result, among others, that the coating is electrically anisotropic. The lateral resistivity of the surface of the photoconductive coating is unusually high while the transverse resistivities are substantially lower. Conductivity through the coating upon exposure to actinic radiation is substantial. The charges held on or near the surface do not readily migrate laterally but are retained relatively immovable. Each crystallite of the coating has its own electrical field when charged. Each field attracts toner particles independently of all other fields.

The practical resolution capabilities of the electrophotoconductive coating of the referenced patent for the purpose of electrophotographic reproduction of images depends to a considerable extent upon the minimum size of the toner particles available and the utility as well as the capability of presenting to the electrostatic image toner particles of such size and in sufficient quantity to achieve the sought after toner density.

The employment of development processes using liquid toner suspensions enables the use of finer particle toners than are used with dry methods which in turn enables the achievement of resolution results commensurate with the capability of the patented photoconductive coating. Ultra fine particles are available only via liquid toner suspension.

Difficulty has been encountered in achieving uniform toning over the width of the latent charge image. Uniform toning demands uniformity of the toner particle suspension fed to the photoconductive surface. Agitation of the toner suspension within the applicator tank was considered essential to proper development. With agitation there develops undesired turbulence which often continues during the feeding of the toner suspension to the photoconductive surface to be toned. The amount of toner delivered to the toning location and hences to the latent image must be carefully controlled.

Other problems encountered during the conventional electrophoretic process of developing electrostatic latent charge images include spillage of toner and the insulating liquid medium either from its container or from the applicator roller; the necessity of and difficulty in removing excess toner from the photoconductive surfaces; difficulties in establishing a uniform precise toning gap and, as well, the proper electrical bias voltage across the gap and the lack of versatility as to the type and concentration of the toner particle which can be employed.

It is important to provide for distributive uniformity in the suspension presented to the latent image. There is a tendency for the suspended toner particles to agglomerate into large clumps or accumulations of particles. If the relative ratio of particle to carrier liquid becomes too great, uneven toning results. The flow pattern of the developer must not be turbulent.

Employing known techniques it has been found difficult to define and to maintain uniformity of the toning gap, that is, at the toning location. Additionally too much insulating liquid may be delivered to the toning gap and hence must be dealt with to meet environmental standards as to contamination.

As briefly mentioned conventional electrophoretic toning processes employ relatively dilute suspensions of toner particles in an insulating liquid.

A most serious impediment in liquid toning processes resides in the time duration needed for the toner particles to move through the dispersant liquid toward the photoconductive surface requiring many seconds, much less than the duration sought for high speed operation. A faster process for toning has been sought.

Another difficulty experienced in liquid toning processes involves the removal of excess carrier or insulating liquid. Further, an insufficient number of toner particles may be delivered to the latent image at the toning station. Thus incomplete toning may result unless the duration of toning is extended and/or multiple toning passes are effected. Often there occurs unacceptable reduction in optical density, failure evenly or uniformly to tone all portions of the latent image, migration of toner particles preferentially to certain select areas of the latent image and random washing of toner. Electrophoretic migration of the toner particles through the insulating liquid medium has been found to enhance the formation of so-called Bénard convection cells. These cells may be attracted preferentially over the toner particles to the surface of the photoconductor and deny access to the photoconductive surface by toner particles otherwise attractable thereto, tiny voids being formed in the toned image.

Conventional electrophoretic toning methods have been electrically assisted by use of development electrodes and precise toning gaps. Establishment and maintenance of these gaps require tolerances to be maintained which considerably increase the cost of the equipment. The necessity for the toner particles to traverse a considerable distance through the liquid carrier generally increases the voltage required for electrical toning assistance. This in turn requires many precautions to be taken, such as in electrically isolating connections, etc.

Evaporation of the insulating liquid attendant with the use of low viscosity suspensions as well as the loss of liquid due to spillage, loss by excessive application to the belt, carryover due to the excess, etc. loss due to liquid creep, whipping due to the relative high speed operation and undesired layering of flow and turbulence at the delivery location are problems encountered during conventional electrophoretic toning processes which give rise to the desire for a different and improved developing process. Layering causes differential adhesion to the particles to the surface areas.

Depletion of the toner suspension generally has been rapid so that frequent replenishment of the toner suspension at the toning station has been required. Thus the provision of a supply tank for fresh toner supply vessel and attendant feed means generally is mandatory auxiliary equipment.

It would be highly desirable for maximum space utilization and cost reduction if the necessity for replenishment of the toner suspension during the normal run life would be avoided; however, so long as electrophoretic toning processes are used, dilute solutions generally will be employed and replenishment factors such as provision of secondary reservoirs, tanks, conduits, valving, etc. apparently are required.

In addition to cost reduction, both on construction, fabrication, assembly and maintenance, improvement of the effective toning process, the achievement of desirable optical density and resolution characteristics commensurate with the ability of the electrophotographic member to perform should be the goal sought by way of improvement in the development process.

SUMMARY OF THE INVENTION

The invention herein provides a method and apparatus for toning electrostatic latent images by presenting in very close proximity to the latent image, a thin viscous layer of toner particles carried by an applicator roller with minimal insulating carrier liquid present functioning only to maintain the separate integrity of said particles. The toner particles, having a preferential adherence for the stronger electric field of the latent image compared with their retention upon said roller, change their position re adherence without moving through the liquid to transfer to the latent image carrier under the dominant electric field strength thereof. The layer of toner for transfer can be formed by electrolytic deposition from a relatively dilute suspension of particles as found in conventional liquid suspensions of said toner particles; or by providing toner particles large enough to form a layer on the applicator roller having a thickness fully to occupy the very narrow "virtual zero gap" defined between the applicator roller and the photoconductive surface.

DESCRIPTION OF THE PREFERRED EMBODIMENT

Figure 1:
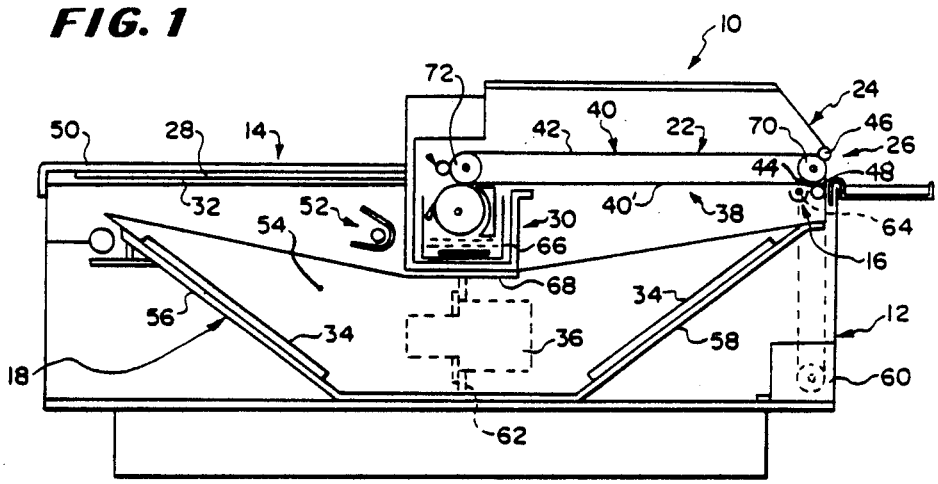
FIG. 1 is a diagrammatic representation of an electrophotographic imaging apparatus incorporating a toning or development station according to the invention.

The conventional process for toning a latent electrostatic image produced on a photoconductive surface by electrophotographic processes employs relatively dilute suspensions of electrophoretic toner particles in an insulating liquid medium. Charged toner particles dispersed in the insulating liquid are forced to travel through the liquid medium toward the photoconductive surface carrying the electrostatic latent electrostatic charge image.

The magnitude of the surface charges forming the latent image may be amplified using a bias voltage to drive the particle(s) toward the charged surface. The strength of the electric field at the surface will determine the number of toner particles attracted and held at any one area of the latent image. Flow patterns within the liquid may constitute a problem during conventional electrophoretic processes. Ordinarily, the speed of travel of the latent image carrier necessarily is limited to enable a sufficient number of toner particles to pass through the liquid and reach the latent image to render same visible as a faithful reproduction of the desired image characterized by satisfactory optical density and resolution.

The invention may be summarized as substituting for an electrophoretic toning method a toner transfer method by applying at thin viscous high density layer of toner particles on the circumferential surface of a roller and bringing the layer thus formed to the photoconductive surface transferring selected portions to the photoconductive surface dependent primarily upon the electric field strength of the latent image. A "virtual zero gap" is established between the roller and the photoconductive surface of the order of the thickness of said layer.

Preferably, the thin viscous toner layer is applied to the roller by electrodeposition from a conventional toner suspension in an insulating liquid medium within a chamber defined by arcuate electrode spaced from and generally following the circumference of the roller and extending a predetermined distance along said circumference. In the chamber the charged toner particles in suspension travel toward the roller surface. The depleted insulating liquid migrates toward the electrode and is returned to the suspension. Particles of toner each carry a charge of one polarity (here positive polarity) with the surrounding liquid carrying a charge of opposite polarity. The toner particles are repelled, their separate integrity maintained by the surrounding layer of liquid medium surrounding each particle. If the toner particles are large, and their concentration high, the viscous toner layer may be laid down without electrical assistance.

Notwithstanding the fact that a liquid suspension of toner particles in insulating liquid medium is employed, as in conventional toning processes, the invention employs same in a transfer process whereby toning speed attained is substantially greater than achievable with conventional liquid toning.

With viscous transfer toning according to the invention herein, a fully developed image can be achieved using line contact between application roller and photoconductor in one to three milliseconds attaining toning speeds as fast as one foot per second or more without the necessity of using a bias plate.

For electrodeposition of the viscous toner layer the applicator roller is coupled to a voltage source of negative polarity. The elongate arcuate electrode is grounded and has a curvature generally following the circumferential surface of the roller and is spaced from said surface to define an electrodeposition chamber.

The electrode is positioned so that the chamber has an enlarged entrance and the chamber tapers to a reduced delivery opening proximate the photoconduction surface. The upper delivery edge of the electrode is tapered to a feather or blade edge just spaced from the roller surface a distance closely proximating the thickness of the layer of toner formed on the roller. The cross-section of the electrode is hydrodynamic or streamlined to reduce turbulence.

An endless electrophotographic belt having an outer photoconductive coating is mounted upon a pair of spaced rollers to define a pair of opposite parallel reaches. The center axes of the belt rollers are parallel. One of the belt rollers is driven while the other roller constitutes a follower roller. When the belt is mounted on the rollers and installed, the follower roller is positioned with its center axis offset from the center axis of the applicator roller. The offset disposition of the follower roller at the toning station functions to maintain the belt taut whereby to define a very short planar section of the belt tangential relative to both the applicator roller and the follower roller. The tautness of the belt prevents wrinkling or stretching at the toning location and further prevents run-back of toner liquid along the belt in a direction toward the exposure station. Tautness of the bent ensures a uniform line across the belt along the center line of the virtual zero toning gap which is defined therebetween.

Although the toner particle to liquid ratio is high along the electrodeposited viscous layer, there still remains enough liquid to surround each particle for maintaining the integrity of each particle. Upon transfer of the particles to the photoconductive surface such liquid as transferred along with the particles as well as any excess number of transferred particles is removed from the said surface by an extraction roller positioned closely adjacent to the follower roller and with its center axis parallel and coplanar with the axis of the follower roller. The remanent toner accumulations remain as sponge toner accumulations on the photoconductive surface held thereto by the electric field strength of the latent image.

It should be clearly understood that the toner particles are transferred by changing their adherence from the roller surface to the photoconductive surface rather than travelling through a liquid body as is the phenomenon observed during electrophoretic toning processes.

Referring now to the drawing, in FIG. 1 there is illustrated, diagrammatically, a representation of the electrophotographic imaging apparatus device, such as a convenience copier, for example, which is designated generally by reference character 10. Copier 10 is provided with a housing 12 in which are mounted the various functional stations. The functional stations include an imaging platen assembly 14, a charging assembly 16, an optical projection assembly 18, an electrophotographic belt assembly 22, a transfer medium supply and feed assembly 24, a transfer assembly 26 and, shown installed nested within the optical assembly 18, the toning station 30 for practicing the toning method according to the invention.

A document or other original 28 to be imaged is placed face down upon the transparent platen 32 and illuminated. The image is projected by mirrors 34 and the lens system 36 to a portion of the electrophotographic belt along the lower belt reach at an exposure location 38 downstream of the charging assembly 16.

An electrostatic image formed on the bottom surface of the belt at the exposure location 38 is moved past the toning station 30 and proceeds along the upper reach 42 of the electrophotographic belt 40 of belt assembly 22.

A sheet of transfer material such as plain paper is delivered to the transfer station 26 simultaneously with the arrival of the toned latent electrostatic image. A nip 44 is defined between the belt 40 and a transfer roller 46 at the transfer station. Suitable electrical bias is applied at the nip 44 so as to assist transfer of the toned image to the transfer medium and the latter carrying the transferred toned image is delivered to a receptor chute. The belt 40 continues its travel to pass through the cleaning station 48 where any residual toner is removed to render the photoconductive surface capable of being once more charged, exposed, etc. in another cycle.

The imaging platen assembly 14 includes a transparent platen 32 for receiving the document 28 face down. Hinged cover 50 is mounted on housing 12 and is brought over the document 28 and clamped or otherwise held in place. Suitable light sources such as lamps 52 are mounted in the housing 12 below the platen 32 for illuminating the face of the document 28 when reproduction is desired.

A single molded basketlike member 54 is provided having a pair of angularly arranged facing walls 56,58 on which mirrors 34 are secured. The lens system 36 is mounted on partition 62 of basket 54.

Charging station 16 is disposed adjacent the commencement of the lower reach 40' of belt 40 and includes a corona generating device 64 which functions to apply a uniform charge potential to the photoconductive coating of the belt as it passes toward the exposure station 38.

The toning station 30 is located adjacent the terminus of the lower reach 40' of belt 40 at the left end downstream of the exposure station 38 and includes an open top cartridge 66 seated across the basket 54 upon a ledge 68 or similar support formed on said basket 54.

The belt 40 is an endless loop of substrate on which is applied a thin layer of an ohmic material and a sputter deposited coating of photoconductive material such as described in U.S. Pat. No. 4,025,339. In case of a metal belt the photoconductive coating is deposited directly on the substrate. The belt 40 is mounted on the rollers 70,72 which in turn are mounted on a frame 74 for removable coupling to the housing 12.

The rollers 70,72 are of the same diameter, roller 70 being driven by motor 60 and roller 72 being the follower roller. Tension is applied to one of the rollers 70,72 in turn applying tension overall to the belt 40. Follower roller 72 is adjacent the toning station 30 represented by the cartridge 66.

A supply and feed assembly for a transfer medium such as paper sheets, is superposed over the belt assembly for feeding transfer media, here successive sheets of paper, to the transfer station 26 at the terminus of the upper reach 42 of belt 40.

The transfer station 26, including transfer roller 46, is positioned for transferring the toned image carried by the belt 40 to the sheet of paper at the nip 44.

Between the transfer station 26 and the charging station 16, the belt 40 is brought past the cleaning station 48 which includes corona generating means 64 applying a positively charged corona, and cleaning roller means 80 for removing any residual toner remaining on the belt not transferred with the image.

Attention now will be directed to the toning station 30. The toner cartridge 66 has applicator roller 82 mounted for rotation in a bath of toner suspension carried in the cartridge 66. The roller 82 is driven through gear and belt means (not shown) or by the drive means for the belt 40 so that the applicator roller 82 is driven at the same linear speed as the belt 40 and in the same direction. The roller 82 is spring biased against the belt 40. End washers or spacers may be provided to define the minimal gap or, preferably as shown, establishment of the virtual "zero" gap is effected by interposing the viscous toner layer between the roller 82 and the belt 40.

An elongate electrode 84 is mounted in the cartridge 66 along substantially the full length of the roller 82. Electrode 84 is an arcuate plate having a hydrodynamic or streamlined cross-sectional configuration to reduce turbulence. The upper portion 86 of the electrode is beveled to a feather edge 88 and is spaced closer to the circumference of the roller 82 at its upper edge 88 than elsewhere. The lower edge 90 defines a wider entrance to the electrode deposition chamber 92 defined by the facing circumference surface of the roller 82 and the facing electrode 84.

Figure 2:
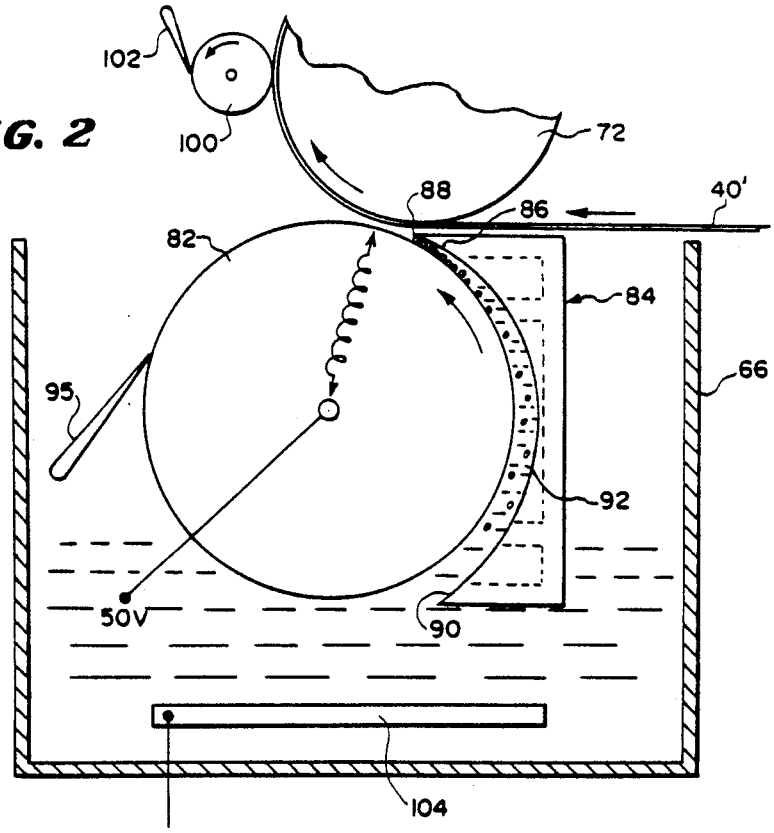
FIG. 2 is a diagrammatic representation of the development method according to the invention.
Figure 3:
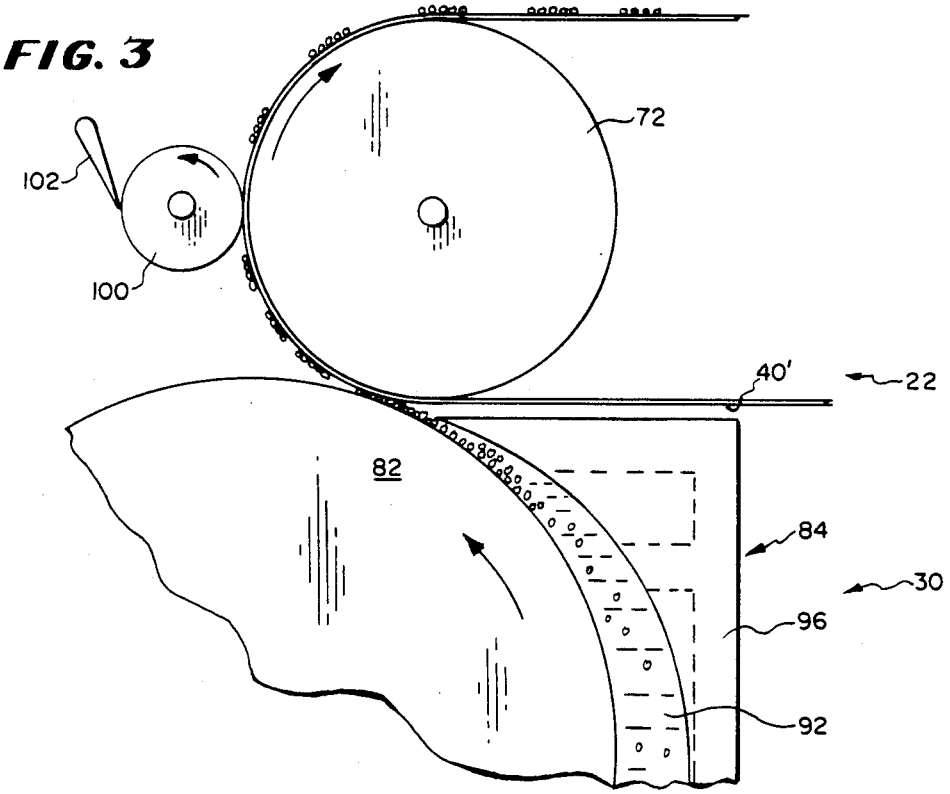
FIG. 3 is an enlarged diagrammatic representation illustrating the method according to the invention.
Figure 4:
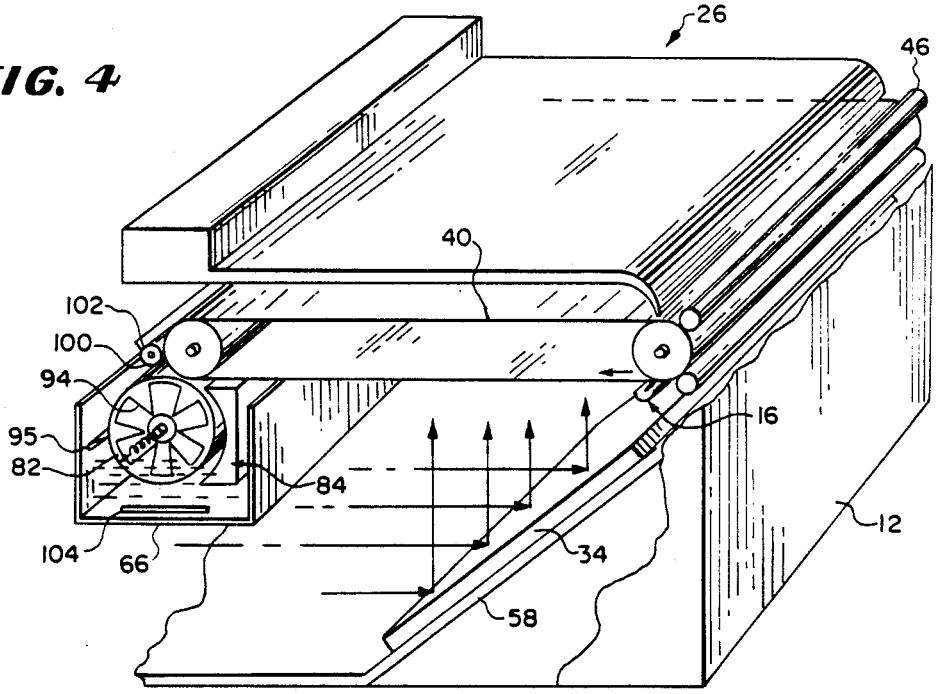
FIG. 4 is a diagrammatic perspective view of the development, imaging and transfer stations of an electrophotographic imaging apparatus such as illustrated in FIG. 1.

Referring to FIG. 4, the applicator roller 82 can be hollow and open ended. The roller 82 is provided with plural longitudinal interior vanes 94 which function to agitate the suspension as the roller 82 is rotated. The electrode 84 also can be provided with ribbed perforate body 96 (FIG. 2) including slots to permit the separated clear toner-free liquid to flow slowly back into the principal bath of toner suspension.

The electrode 84 formed in the grid-like perforate configuration provides many paths for returning the toner free insulating liquid to the principal bath of suspension. Baffles and/or slots may comprise an alternate form. The roller 82 may be provided with a circumferential surface consisting of an electrically insulative material such as aluminum oxide, plastic or glass to prevent discharge of the charged electroscopic toner particles.

A small diameter extraction roller 100 is arranged for rotation with both belt and application roller at a location downstream of the toning location. Doctor blade 102 is provided to operate on the surface of the extraction roller 100. The primary purpose for the extraction roller 100 is to pick up excess insulating liquid and any loose or excess particles, as well as any floating particles of which there are few.

A bias voltage of 50 V negative plarity is placed on the applicator roller 82 with both the belt 40 and electrode 84 being of the same polarity, generally grounded or positive relative to roller 82.

The toner suspension employed ultimately herein is very viscous and consists of a toner particle/insulating liquid suspension with a very high ratio of toner particles to insulating liquid. The thin viscous highly dense layer formed according to the invention preferably can be formed by electrodeposition from a toner suspension of conventional viscosity.

The toner suspension is drawn or pumped into the electrodeposition chamber. As the suspension travels along the chamber toward the delivery location, the positively charged toner particles are attracted to the circumference of the roller 82 while the liquid is attracted toward the electrode. The toner suspension entering the chamber effects a laminar flow pattern, with layers of particles drawn to the circumferential surface of roller 82. By the time any given area of the roller 82 has rotated from the entrance to the chamber to the delivery location, a very thin viscous layer of toner particles is formed on said roller area no more than 15 microns thick. The toner particles in the thin layer are separated by the surrounding insulating liquid which remains and which takes on a charge to balance that of the particles. The feathered or blade edge 88 of the electrode 84 serves to ensure a minimal thickness toner layer, highly concentrated and generally uniform. When the belt and the applicator roller are brought into very close proximity along a uniform effective line of contact, i.e. spaced along about 15 to 30 microns, the layer of toner particles is brought into the dominant electric field of the electrostatic latent charge image which is carried by the belt 40. This dominance causes the preferential adherence of the toner particles to the belt 40. The toner particles reverse their dipole orientation to adhere to charged surface of the belt. The transferred electroscopic particles can be said to switch their adherence from the thin layer on the applicator roller to the latent image carried by the belt and not to travel through the liquid.

Upon transferring the viscous toner layer to the latent electrostatic image, the roller 82 is wiped clean, say by doctor blade 95 or a cleaning roller (not shown), as it continues to rotate. The toner deposit is uniformly replated on roller 82 with a fresh layer of electrically attracted toner particles which layer is adequately achieved prior to entry into the image transfer "virtual zero gap".

The magnitude of the bias voltages are such as to provide a dominant field some 75 times greater than the field between the belt 40 and roller 82. The negative voltage (50 to 100 volts D.C.) applied to the applicator roller assures electrodeposition of the toner particles to form the thin viscous highly dense layer on the circumferential surface of the roller 82 as it rotates from the toner suspension through the entrance to the chamber.

One of the problems which may be encountered in the course of toning is that of sedimentation, i.e. separation of the toner particles to result in a thickened deposit at or near the floor of the container. Agitation by rotation of the hollow internally vaned roller 82 may suffice to obviate this. One also may agitate the suspension by applying a relatively high voltage thereto, shocking the suspension and causing the particles from any assumed sediment condition to disperse through the insulating liquid medium. For this purpose, a plate electrode 104 can be disposed within the cartridge next adjacent the floor thereof by spaced and insulated therefrom.

Uniform dispersion of toner particles can be readily achieved through electrical pulsing between the bottom electrode of the tray and the toner applicator roller or the surrounding grid electrode 84.

The plate electrode 104 is coupled either to a source of high D.C. voltage or to an A.C. source where high voltage pulses may be applied to the suspension to disperse the particles scattering same from their sediment condition.

The applicator roller 82 may be spring-loaded with its minimal distance from the photoconductor determined by the viscosity of the toner suspension, the spring force, the curvature at the gap, the geometry of the entrance to the gap and the surface velocity of the roller 82.

An important factor in the invention herein is the definition of the gap so that only the viscous layer of toner particles and the associated minimal accompanying amount of insulating liquid can be accommodated. Applicator means other than a roller is feasible. The toning process is rendered independent of its former dependence upon the toner particle mobility factor.

Variations are capable of being made without departing from the spirit or scope of the invention as defined in the attached claims.

What is desired to secure by Letters Patent of the United States is:

1. A method of developing a latent electrostatic charge image carried on the photoconductive surface of an electrophotographic member by liquid toner comprising the steps of forming a thin viscous highly dense layer of electroscopic toner particles on a carrier therefor, defining a virtual displacement between said carrier and said photoconductive surface, presenting to said member along a uniform area thereof at said virtual displacement said thin viscous highly dense layer of electroscopic toner particles and transferring only latent image developing portions of said layer to the photoconductive member by impressing the carrier onto the photoconductive surface at said virtual displacement with the said layer therebetween, wherein said latent image is developed at said virtual displacement.

2. The method as claimed in claim 1 in which said layer is less than 30 microns in thickness.

3. The method as claimed in claim 1 in which said layer is between 15 to 30 microns in thickness.

4. A method of developing a latent electrostatic charge image on a photoconductive member by liquid toner comprising the steps of presenting to said member along a uniform area thereof a thin viscous highly dense layer of electroscopic toner particles in a suitable carrier liquid and transferring only latent image developing portions of said layer to the photoconductive member under the sole influence of the electric field strength of said latent image, said layer is electrically deposited on an applicator roller from a liquid suspension of toner and the applicator roller surface is spaced from the photoconductive surface by a virtual displacement distance no greater than the thickness of the viscous layer, the transfer occurring upon impression of said roller upon said surface through said layer, wherein said latent image is developed at said virtual displacement.

5. The method as claimed in claim 4 in which the liquid suspension is agitated.

6. The method as claimed in claim 4 in which the liquid suspension is agitated by applying high voltage surge pulses thereto.

7. The method as claimed in claim 4 and the step of spring biasing the applicator roller toward the photoconductive surface.

8. The method as claimed in claim 4 in which the applicator roller is rotated simultaneously with and in the same direction as said photoconductive surface.

9. The method as claimed in claim 4 in which any excess liquid transferred with said portions is removed from the surface immediately subsequent to transfer thereto.

10. A method of developing a latent electrostatic charge image on a photoconductive member by liquid toner comprising the steps of presenting to said member along a uniform area thereof a thin viscous highly dense layer of electroscopic toner particles in a suitable carrier liquid and transferring only latent image developing portions of said layer to the photoconductive member under the sole influence of the electric field strength of said latent image, said layer being electroplated on an applicator roller from a liquid suspension of toner and the applicator roller is mounted to bring its circumferential surface spaced from the photoconductive surface a distance no greater than the thickness of the viscous layer to define a virtual displacement therebetween, the transfer occurring upon virtual displacement impression of said roller upon said surface through said layer, wherein said latent image is developed at said virtual displacement.

11. A method of developing a latent electrostatic charge image on a photoconductive member by a liquid toner applicator means, said method comprising the steps of establishing a virtual displacement between said photoconductive member and the liquid toner applicator means; presenting to said member along a uniform area at said virtual displacement thereof a thin viscous highly dense layer of electroscopic toner particles in an insulating toner medium and transferring through said virtual displacement only latent image developing portions of said layer to the photoconductive member under the sole influence of the electric field strength of said latent image, wherein said latent image is developed at said virtual displacement, said insulating toner medium being present in said layer to the degree necessary only to maintain the separated integrity of the toner particles forming said layer.

12. Apparatus for developing electrostatic latent charge images formed upon the photoconductive coating of an electrophotographic member and comprising:

a canister cartridge having a floor, side and end walls and an open top, said canister cartridge adapted to contain a suspension of electroscopic toner particles in an insulating liquid medium, an applicator roller mounted for rotation within said canister cartridge and disposed to extend partially through the open top thereof, means for forming a thin, highly dense, viscous toner particle layer on the circumferential surface of said applicator roller and means rotating said applicator roller relative to the photoconductive surface close thereto but spaced therefrom a distance at most equal to the thickness of said viscous layer and transferring only latent image developing portions of said layer to said photoconductive surface during passage under the sole influence of the electric field strength of said electrostatic latent charge image, said applicator roller being mounted to establish a virtual displacement between the circumferential surface thereof and the photoconductive coating defining a development station at said virtual displacement whereby development occurs only at said virtual displacement.

13. Apparatus for developing electrostatic latent charge images formed upon the photoconductive coating of an electrophotographic member and comprising:

a canister cartridge having a floor, side and end walls and an oen top, said canister cartridge adapted to contain a suspension of electroscopic toner particles in an insulating liquid medium, an applicator roller mounted for rotation within said canister cartridge and disposed to extend partially through the open top thereof, means for electrodepositing a thin, highly dense, viscous particle layer upon the circumferential surface of said applicator roller and means rotating said applicator roller relative to the photoconductive surface close thereto but spaced therefrom a distance at most equal to the thickness of said viscous layer to define a virtual displacement transferring only a latent image developing portion of said layer to said photoconductive surface during passage under the sole influence of the electric field strength of said electrostatic latent charge image to effect development at said virtual displacement.

14. The apparatus as claimed in claim 13 in which said means for electrodepositing said layer comprise an electrode having a hydrodynamic cross-sectional configuration, said electrode having a blade-like edge disposed closer to the circumferential surface of said roller near a location proximate to the photoconductive surface than at the entrance to said chamber.

15. The apparatus as claimed in claim 13 in which said means for electrodepositing comprise an arcuate electrode hydrodynamic in configuration whereby to reduce turbulence at the location where the said thin, highly viscous particle layer is deposited.

16. The apparatus as claimed in claim 13 in which the amount of residual liquid medium in said viscous layer is sufficient only to maintain the separate integrity of each particle in said layer.

17. Apparatus for developing electrostatic latent charge images formed upon the photoconductive coating of an electrophotographic member and comprising:

a canister cartridge having a floor, side and end walls and an open top, said canister cartridge adapted to contain a suspension of electroscopic toner particles in an insulating liquid medium, an applicator roller mounted for rotation within said canister cartridge and disposed to extend partially through the open top thereof, means for forming a thin, highly dense, viscous toner particle layer on the circumferential surface of said applicator roller, said forming means comprising an elongate arcuate electrode arranged in the canister cartridge spaced slightly from said circumferential surface of the roller to define a chamber therebetween, means establishing a d.c. voltage across said chamber for electrodepositing said viscous layer of toner particles from the toner suspension within the chamber, and means rotating said applicator roller relative to the photoconductive surface close thereto but spaced therefrom a distance at most equal to the thickness of said viscous layer to define a virtual toning gap and transferring portions of said layer to said photoconductive surface during passage under the sole influence of the electric field strength of said electrostatic latent charge image to effect development of the latent image.

18. The apparatus as claimed in claim 17 wherein the entrance to the chamber is wider than at the delivery exit therefrom.

19. The apparatus as claimed in claim 17 where said arcuate electrode has plural generally parallel, spaced baffles and slots adjacent thereto for allowing electrically separated clear suspending medium to be returned to the canister cartridge.

20. The apparatus as claimed in claim 17 in which said arcuate electrode is hydrodynamic in configuration whereby to reduce turbulence at the location leading into said virtual toning gap.

21. The apparatus as claimed in claim 18 in which said arcuate electrode is hydrodynamic in configuration whereby to reduce turbulence at the location leading into said virtual toning gap.

22. Apparatus for developing electrostatic latent charge images formed upon the photoconductive coating of an electrophotographic member and comprising:

a canister cartridge having a floor, side and end walls and an open top, said canister cartridge adapted to contain a suspension of electroscopic toner particles in an insulating liquid medium, an applicator roller mounted for rotation within said canister cartridge and disposed to extend partially through the open top thereof, means for forming a thin, highly dense, viscous toner particle layer on the circumferential surface of said applicator roller and means rotating said applicator roller relative to the photoconductive surface close thereto but spaced therefrom a distance at most equal to the thickness of said viscous layer to define a virtual displacement and transferring only latent image developing portions of said layer to said photoconductive surface during passage under the sole influence of the electric field strength of said electrostatic latent charge image, the amount of residual liquid medium in said viscous layer is sufficient only to maintain the separate integrity of each particle in said layer.

23. An electrophotographic imaging apparatus which includes a latent electrostatic charge image carrier, a charging station, an exposure station, a toning station and a transfer station; said toning station comprising a canister for holding a suspension of toner particles in an insulating medium, roller means arranged mounted for rotation within the canister, means for electrodepositing a thin highly dense viscous layer of toner particles upon said roller means and means for driving said roller means to present said deposited layer to said latent electrostatic charge image carrier at said toning station along a virtual displacement, the dimension of said virtual displacement approximating the thickness of the thin highly dense viscous layer whereby to effect transfer of only latent image developing portions of said viscous layer to said latent electrostatic charge image carrier at said virtual displacement.

24. The imaging apparatus as claimed in claim 23 in which said means for electrodepositing comprise an elongate electrode disposed spaced longitudinally along the roller means to define a separation chamber and means for electroplating toner particles from a conventional toner suspension within said chamber to form said layer.

25. The imaging apparatus as claimed in claim 19 wherein the roller means is spring-biased toward the latent image carrier.

26. The imaging apparatus as claimed in claim 25 in which the distance between the circumferential surface of the roller means and the latent image carrier is such that the gap therebetween is virtually zero.

27. Apparatus for developing electrostatic latent charge images formed upon the photoconductive coating of an electrohotographic member and comprising:

a canister cartridge having a floor, side and end walls and an open top, said canister cartridge adapted to contain a suspension of electroscopic toner particles in an insulating liquid carrier, said electrophotographic member comprising an endless belt mounted on a pair of rollers to define a pair of generally parallel planar reaches, an applicator roller having an axis of rotation and mounted for rotation about said axis and within said canister cartridge, one of the mounting rollers being located mounted proximate to the applicator roller whereby its axis of rotation is offset from the rotational axis of the applicator roller, said applicator roller bing disposed to extend partially through the open top of said canister, means for forming a thin, highly dense, viscous toner particle layer on the circumferential surface of said applicator roller and means rotating said applicator roller relative to the photoconductive surface close thereto but spaced therefrom a distance at most equal to the thickness of said viscous layer to define a virtual displacement and transferring only latent image developing portions of said layer to said photoconductive surface at said virtual displacement during passage under the sole influence of the electric field strength of said electrostatic latent charge image to effect development of the latent image at said virtual displacement.

28. Apparatus for developing electrostatic latent charge images formed upon the photoconductive coating of an electrohotographic member and comprising:

a canister cartridge having a floor, side and end walls and an open top, said canister cartridge adapted to contain a suspension of electroscopic toner particles in an insulating liquid medium, an applicator roller mounted for rotation within said canister cartridge and disposed to extend partially through the open top thereof, means for forming a thin, highly dense, viscous toner particle layer on the circumferential surface of said applicator roller and means rotating said applicator roller relative to the photoconductive surface close thereto but spaced therefrom a distance at most equal to the thickness of said viscous layer to define a virtual displacement and transferring only latent image developing portions of said layer to said photoconductive surface during passage under the sole influence of the electric field strength of said electrostatic latent charge image and extraction means are disposed proximate said photoconductive surface and downstream of said applicator roller and virtual displacement, said extraction means being operative upon said surface subsequent to the transfer of toner particles to said surface to remove therefrom excess toner particles and any liquid transferred therewith.

29. Apparatus for developing electrostatic latent charge images formed upon the photoconductive coating of an electrophotographic member and comprising:

a canister cartridge having a floor, side and end walls and an open top, said canister cartridge adapted to contain a suspension of electroscopic toner particles in an insulating liquid medium, an applicator roller mounted for roration within said canister cartridge and disposed to extend partially through the open top thereof, means for forming a thin, highly dense, viscous toner particle layer on the circumferential surface of said applicator roller and means rotating said applicator roller relative to the photoconductive surface close thereto but spaced therefrom a distance at most equal to the thickness of said viscous layer to define a virtual displacement and transferring portions of said layer at said virtual displacement to said photoconductive surface during passage under the sole influence of the electric field strength of said electrostatic latent charge image, and a plate electrode disposed electrically insulated from but proximate to the floor of said canister cartridge, a source of voltage, means for connecting said plate electrode to said source of voltage and means for applying high energy voltage bursts to said plate electrode for dispersing any agglomerated toner particles present into said toner suspension.

* * * * *